United States Patent [19]

Transport

[11] 4,379,373

[45] Apr. 12, 1983

[54] DISPLAY DEVICE HAVING A COLLAPSIBLE EASEL

[76] Inventor: Felix Transport, 98 Riverside Dr., New York, N.Y. 10024

[21] Appl. No.: 265,106

[22] Filed: May 19, 1981

[51] Int. Cl.[3] ..... G09F 1/12

[52] U.S. Cl. ..... 40/152.1; 40/124.1

[58] Field of Search ..... 40/152.1, 124.1; 248/459, 455

[56] References Cited

U.S. PATENT DOCUMENTS

| | | | |
|---|---|---|---|
| 588,636 | 8/1897 | Engstrom | 40/152.1 X |
| 1,515,338 | 11/1924 | Carter | 40/152.1 X |
| 2,383,776 | 8/1945 | Cross | 40/152.1 |
| 2,419,823 | 4/1947 | Cross et al. | 40/152.1 |
| 3,473,777 | 10/1969 | Ketterer | 248/459 |

FOREIGN PATENT DOCUMENTS

| | | | |
|---|---|---|---|
| 246147 | 10/1947 | Switzerland | 40/152.1 |

*Primary Examiner*—Gene Mancene
*Assistant Examiner*—Wenceslao J. Contreras
*Attorney, Agent, or Firm*—James David Jacobs

[57] ABSTRACT

A display device formed having a front face and a collapsible easel is provided. The collapsible easel includes a guide panel. A support panel has first and second edges, the first edge of which is hinged to said guide panel. A stay panel is provided, which has first and second edges, the second edge of which is hinged to the display device and the first edge which is hinged to the second edge of said support panel. A guide panel has at least one tongue which rides in a groove formed by a flap hinged to the front face and folded over to lie against the reverse side of the front face. With the tongue riding in the groove the guide means moves from a first position at which the stay panel and support panel are substantially coplanar to a second position at which said support panel and stay panel form an angle to each other. The hinge between said support panel and stay panel and the bottom edge of said front face form two legs to support the display device at a predetermined angle to a surface.

9 Claims, 11 Drawing Figures

FIG. 4
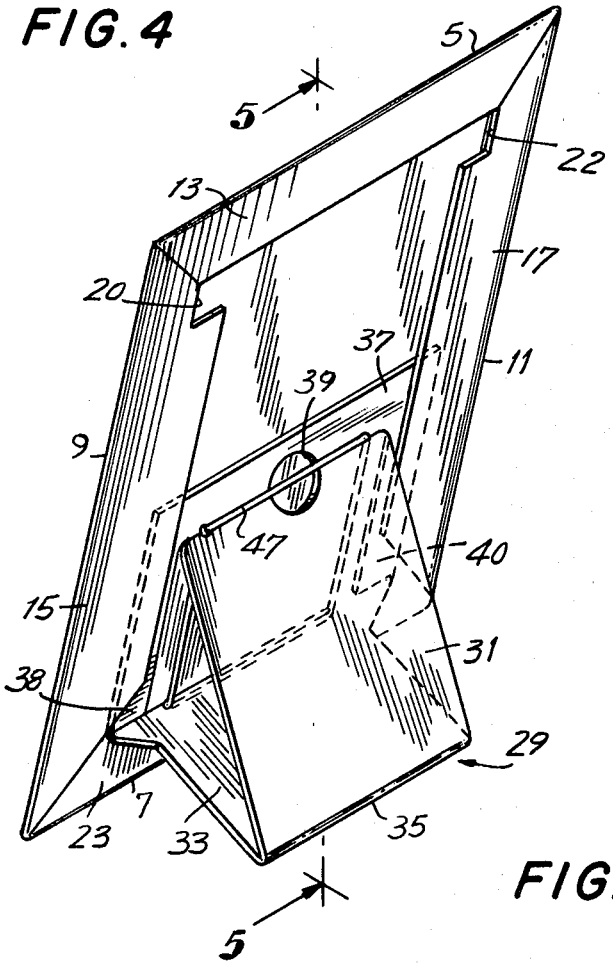
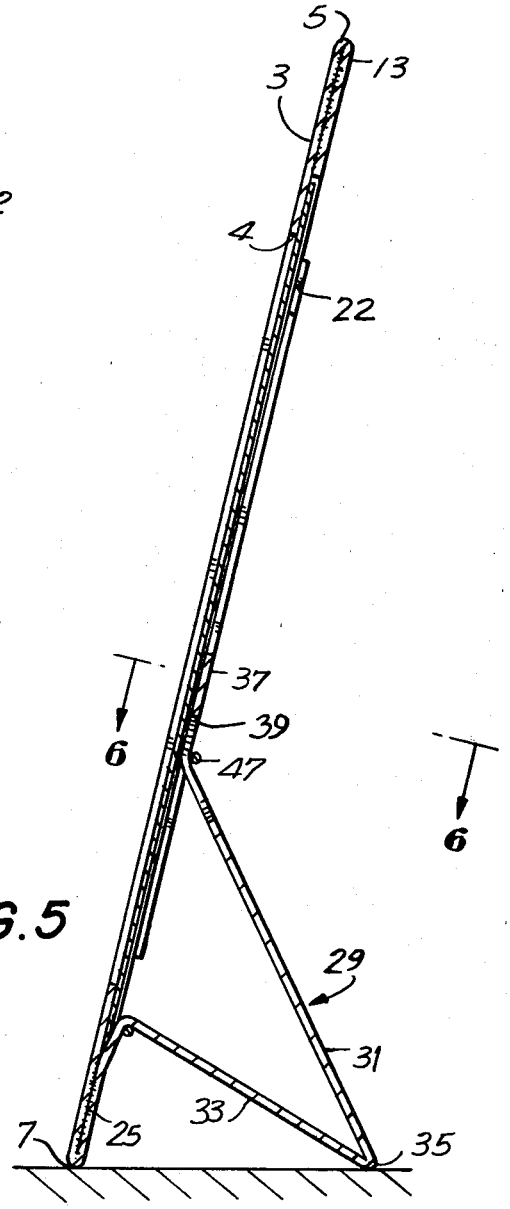
FIG. 5
FIG. 6
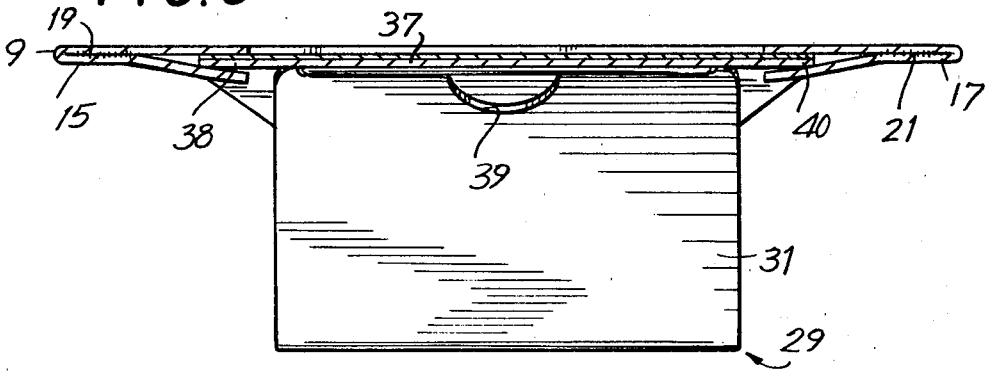

FIG. 7
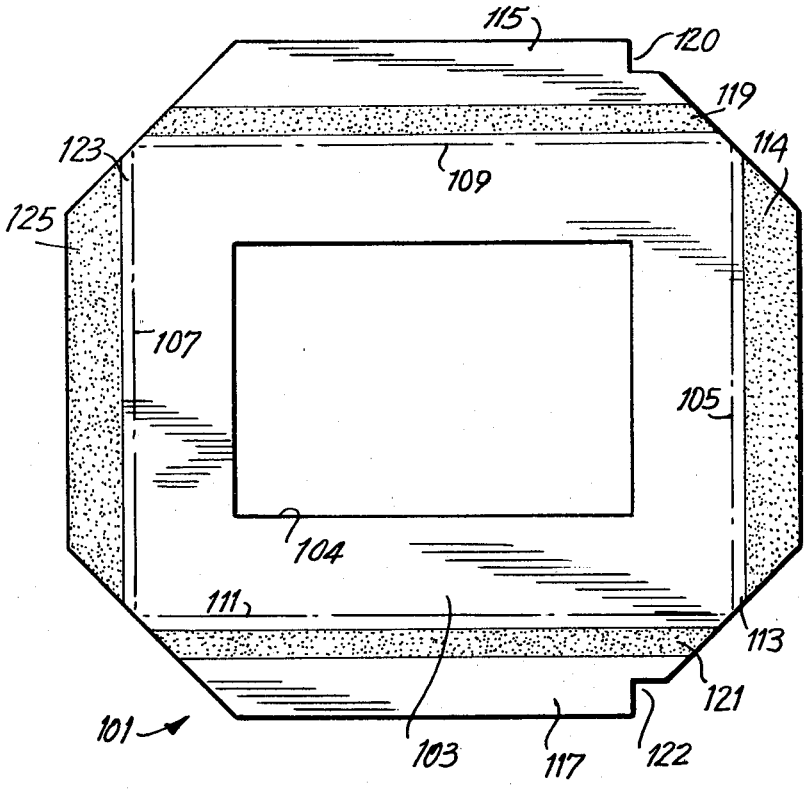
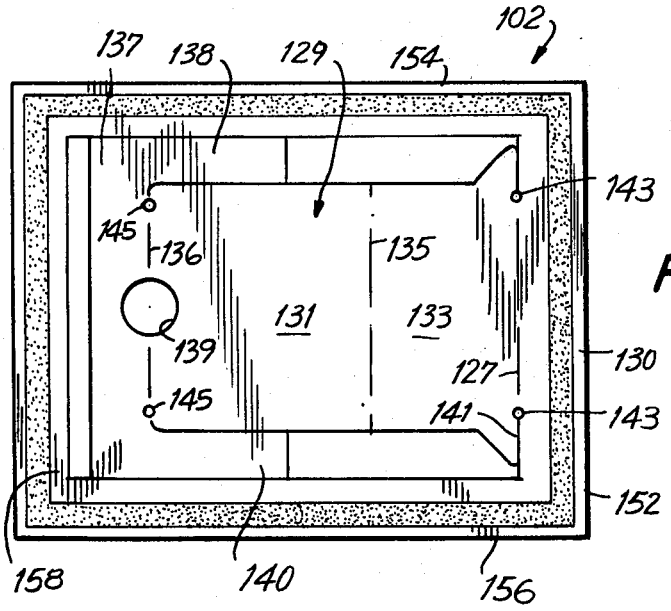
FIG. 8

DISPLAY DEVICE HAVING A COLLAPSIBLE EASEL

BACKGROUND OF THE INVENTION

1. Field of Invention

The invention relates generally to paper constructions, particularly display devices, and is more specifically directed to such devices having a collapsible easel to support the device at a predetermined angle to a horizontal surface.

2. Prior Art

In U.S. Pat. No. 4,149,630, now U.S. Pat. No. Re. 30,695, issued to the inventor of the present invention, and U.S. Pat. No. 4,291,798, application Ser. No. 135,539, filed Mar. 31, 1980, also by the present inventor, there are disclosed other display devices having collapsible easels. In the former patent the display device has a back panel. Hinged to that back panel is a stay flap. A strut is formed by a stay panel hinged to a support panel. The support panel is hinged to the interior of the back panel and the stay panel is hinged to the interior of the stay flap. When deployed, the stay panel rests against the stay flap and the support panel supports the back panel at a predetermined angle to the surface.

In the latter there is also provided a collapsible easel having a stay flap, a support panel and a stay panel. The support panel is hinged to the interior of the back panel and the stay panel is hinged to the edge of the stay flap not hinged to the bottom edge of the back panel. The stay panel has a glue flap which is hinged to the stay flap, and a stay leaf which is hinged to the support panel.

In those prior inventions numerous embodiments are disclosed. All those embodiments are substantial improvements over the prior art. They provide for display devices automatically manufacturable from a single continuous sheet of material. Also the easels can either be manually deployed or automatically deployed. For example, although more efficient than the prior art, those inventions required both back and front panels.

Discussed fully in the foregoing patents and applications is the prior art, e.g., U.S. Pat. Nos. 3,357,671; 2,507,947; 2,783,013; and 1,860,324. Other prior art of interest is U.S. Pat. Nos. 1,860,324; 1,330,946; 527,691; Re. 22,109; 1,621,754; 2,159,887; 2,716,485; 3,013,668; 3,035,363; and 3,130,510; and British Pat. No. 113,330.

Accordingly, it is an object of the present invention to provide a display device having a collapsible easel, which can be made from a single blank for ease of construction or from a plurality of blanks for economy.

It is another object of the present invention to provide for such a display device which can be quickly and easily assembled.

It is another object of the present invention to provide for such a display device which is collapsible and occupies relatively little or more additional room in a collapsed state than the assembled card for which it provides support.

It is another object to the present invention to provide such a display device which does not require intricate assembly prior to deployment.

It is another object of the present invention to provide such a display device which can be automatically manufactured without manual assembly by machine die cutting, scoring, gluing, and other automated techniques.

It is another object to the present invention to provide for such a display device that permits the blanks therefor to be closely abutted so as to make efficient use of the sheet material from which they are cut.

It is another object of the present invention to provide for a display device they can either be manually deployed or with minor modification automatically deployed by elastic means.

It is another object of the present invention to provide for the above objects through a simple, clean, attractive and relatively economical construction.

SUMMARY OF THE INVENTION

According to one embodiment of the present invention the above and other objects are obtained by a display device having a front face and a collapsible easel. The collapsible easel includes a guide panel. A support panel has first and second edges, the first edge of which is hinged to said guide panel. A stay panel is provided, which has first and second edges, the second edge of which is hinged to the display device and the first edge of which is hinged to the second edge of said support panel. A guide panel has at least one tongue which rides in a groove formed by a flap hinged to the front face and folded over to lie against the reverse side of the front face. With the tongue riding in the groove the guide means moves from a first position at which the stay panel and support panel are substantially coplanar to a second position at which said support panel and stay panel form an angle to each other. The hinge between said support panel and stay panel and the bottom edge of said front face form two legs to support the display device at a predetermined angle to a surface.

DESCRIPTION OF THE DRAWINGS

A more complete appreciation of the invention and many of the features will be readily apparent by reference to the following description when considered in connection with the accompanying drawings.

FIG. 4 is a rear perspective view of the fully assembled and deployed display device according to the embodiment of FIG. 1.

FIG. 5 is a cross-sectional view of the fully deployed display device along line 5—5 of FIG. 4.

FIG. 6 is a cross-sectional view of the fully deployed display device of the preferred embodiment along line 6—6 of FIG. 5.

FIGS. 7 and 8 are a plan view of precut blanks which form another embodiment of the present invention.

Figure 1:
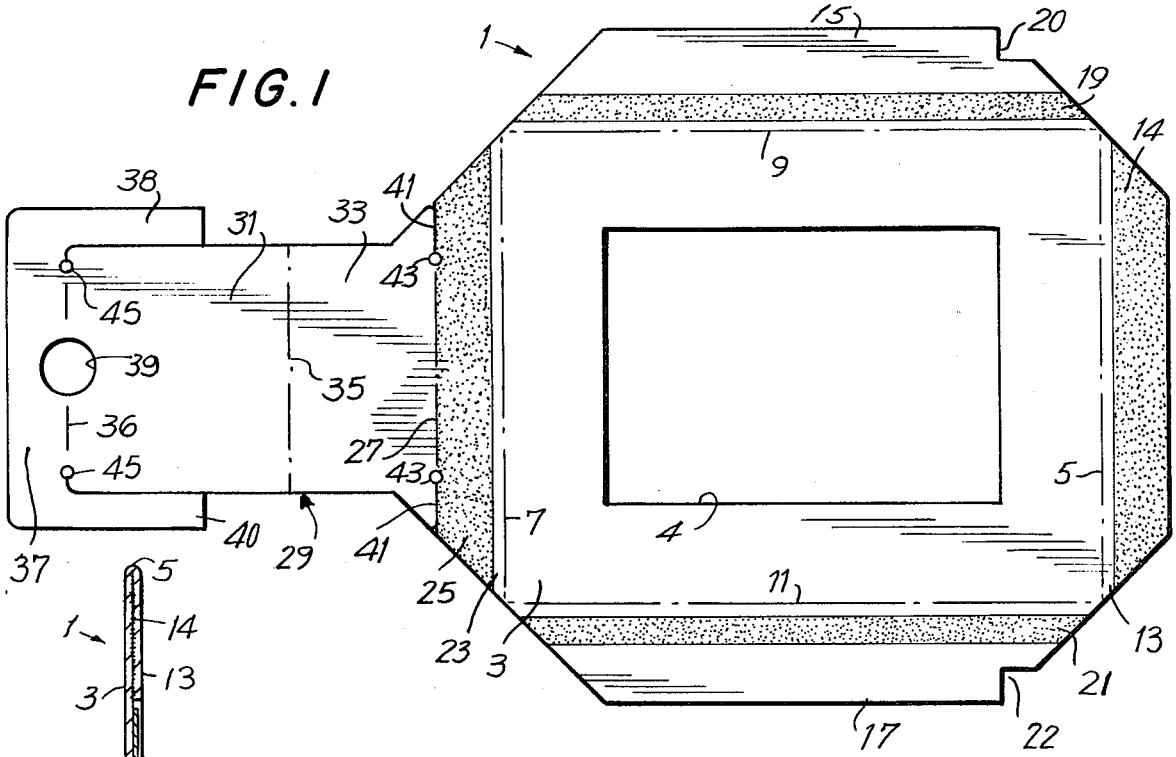
FIG. 1 is a plan view of the precut blank which forms one embodiment of the present invention.

The present invention would be best understood from consideration of the following detailed description taken in connection with the above described drawings. One skilled in the art will recognize, that the invention is not confined to the embodiment in variations shown in the drawings and described in the following description.

DESCRIPTION OF INVENTION

In the drawings like reference characters designate corresponding parts throughout the several views. The preferred embodiment shown and described is a picture frame for displaying a photograph or informative printed card within an attractive frame. A collapsible easel supports the frame at a predetermined angle on a horizontal surface such as a counter or table.

In FIG. 1 display device 1 includes a front face 3. As shown here the reverse side of front face 3 is visible, i.e., the side that will be hidden after display device 1 is fully assembled. Front face 3 has an aperture 4 through which can be viewed a photographed or a printed display card, as will become fully apparent below. Along the top edge of front face 3 is a top score 5, along the bottom edge of front face 3 is a bottom score 7, and along the side edges of front face 3 are side scores 9 and 11.

Hinged to front face 3 by top score 5 is a top flap 13 and hinged to the side edges of front face 3 by side scores 9 and 11 are side flaps 15 and 17, respectively. As shown by stippling top flap 13 has glue 14 over almost its entire surface, whereas flaps 15 and 17 have narrow strips of glue 19 and 21 near scores 9 and 11, leaving a wide unglued band on side flaps 15 and 17 near their outer edge.

Bottom flap 23 is separated from front face 3 by bottom score 7. Bottom flap 23 also has glue 25 over substantially its entire surface.

Also to be noted is the shape of the ends of the flaps 13, 15, 17 and 23. All adjacent flaps have their ends cut so that their end edges are perpendicular to an intersecting diagonal of front face 3. This shape permits flaps 13, 15, 17 and 23 to be folded against the reverse side of front face 3 without overlapping each other. Side flaps 15 and 17 also have notches 10 and 22 formed at their outer edges nearest the top edge of front face 3. As noted below notches 20 and 22 facilitate inserting of a photograph or card means into display device 1.

Hinged to bottom flap 23 by score 27 is collapsible easel 29. Collapsible easel 29 comprises a support panel 31 and a stay panel 33. Stay panel 33 is hinged to bottom flap 23 by score 27. Support panel 31 is hinged to stay panel 33 by score 35.

A guide panel 37 is hinged by score 36 to support panel 31. As best seen in FIG. 1 guide panel 37 is a U-shaped member, tongues 38 and 40 forming the leg members of the U-shape. An aperture 39 is also formed at least partially in guide panel 37, substantially centered along score 36.

Also shown in FIG. 1 are slits 41 on score 27 running from the edge of collapsible easel 29 and terminating at apertures 43. Also provided are apertures 45 at the terminus of the slits that define tongues 38 and 40 of guide panel 37 from support panel 31. Apertures 43 and 45, as one skilled in the art would readily recognize, serve the purpose of preventing the slits for which they form the terminus from propagating further along scores 27 or 35.

ASSEMBLY AND OPERATION OF FIGS. 1–7

As one skilled in the art will recognize display device 1 can easily be made automatically through machine die cutting, gluing, and folding. Furthermore, display device 1 is made from a continuous sheet of material. Also by reason of its shape each device uses a minimum amount of material to form a single blank, and adjacent blanks can be placed close together, wasting little material.

To assemble display device 1 bottom flap 23, collapsible easel 29, and guide panel 37 are folded as a planar unit into contact with the reverse side of front face 3. Similarly, top flap 13 and side flaps 15 and 17 are folded against the reverse side of front face 3 along scores 5, 9 and 11 respectively. Pressure is exerted upon flaps 13, 15, 17 and 23, causing glue strips 14, 19, 21 and 25 to fix their respective flaps to the reverse side of front face 3.

To complete display device 1 of the preferred embodiment an optional elastic band 47 is placed onto display device 1 by running it over scores 36 and 27 and underneath collapsible easel 29. The fully assembled display device 1 in its undeployed position can be viewed in FIGS. 2 and 3.

Figure 2:
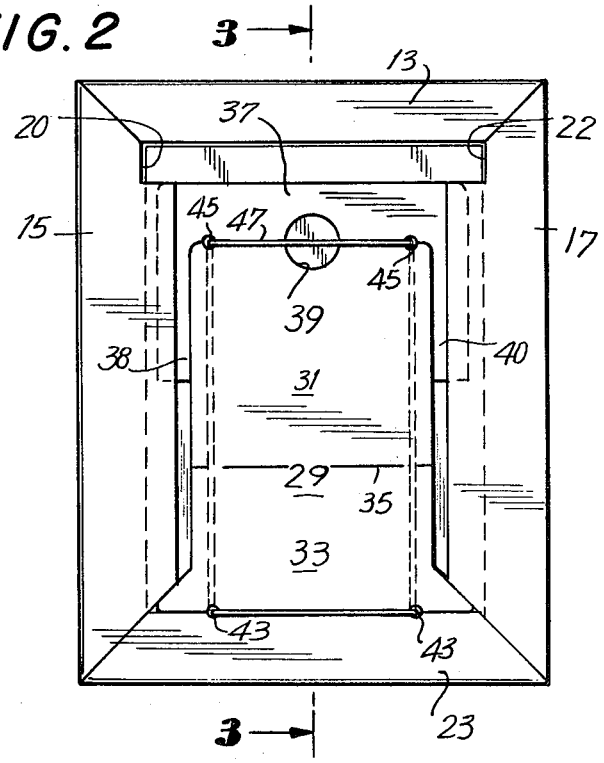
FIG. 2 is a rear elevation of the fully assembled display device of the embodiment of FIG. 1.
Figure 3:
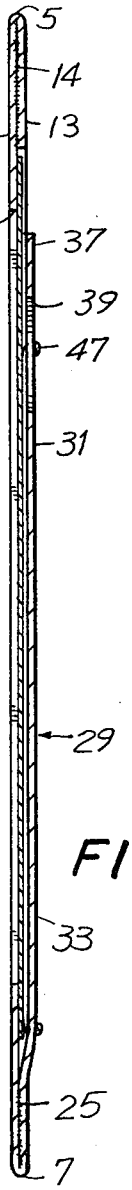
FIG. 3 is a cross-sectional view along line 3—3 of the present invention shown in FIG. 2.

As shown in FIG. 2 display device is in an unstabled state. That is, the force exerted by elastic band 47 tends to force the collapsible easel 29 to deploy display device 1 as seen in FIGS. 4–6.

In deploying guide panel 37 remains fully in contact with the reverse side of front face 3. Tongues 38 and 40 move in the grooves formed between side flaps 15 and 17 and the reverse side of front face 3. Elastic band 47 continues to cause guide panel 37 to move until the lower extremity of tongues 38 and 40 contact the top edge of bottom flap 23, causing guide panel 37 to stop.

As best can be seen in FIGS. 2 and 4 notches 22 and 24 permit insertion of a photograph or other card means into the grooves formed between side flaps 15 and 17 and the reverse side of front face 3. Furthermore, the top edge of guide panel 37 directs the photograph between guide panel 37 and the reverse side of front face 3. The photograph can then be viewed through aperture 4.

DESCRIPTION OF FIGS. 7–11

In FIGS. 7–11 another embodiment of the present invention is illustrated. Rather than formed out of a single continuous sheet, in this embodiment the display device is formed from two blanks 101 and 102. One skilled in the art would recognize that although the total area of blanks 101 and 102 is slightly greater than that of the blank of the embodiment of FIG. 1, making a display device out of two blanks has advantages. Although the total area of the blanks may be greater, because of layout efficiency, the actual sheet material consumed will be less. Also, where front face 102 of the display device is to be made of an expensive material, such as velour, satin, or foil, the total cost of the display device will be less if the not visible portions are made from a less expensive sheet material. Furthermore, as it will become obvious from the below description, the device pursuant to the embodiment of FIG. 7 will be stronger because of additional plys of material.

In the ensuing description reference characters designating parts corresponding to like parts in the embodiment of FIG. 1 carry the same last two digits. Accordingly as shown in FIG. 7 the reverse side of the front face 103 is visible, i.e., the side that will be hidden after the display of embodiments of FIGS. 7 and 8 is fully assembled. Front fact 103 has an aperture 104 through which can be viewed a photograph or printed display card. Like the preceeding embodiment along the top edge of front face 103 is a bottom score 107, and along the side edges of front face 103 are side scores 109 and 111.

Similarly, hinged to front face 103 by top score 105 is a top flap 113, hinged to the side edges of front face 103 by side scores 109 and 111 are side flaps 115 and 117, respectively. As shown by stippling top flap 113 has glue 114 on almost its entire surface, whereas flaps 115 and 117 have narrow strips of glue 119 and 121 near scores 109 and 111, leaving a wide unglued band on side flaps 115 and 117 near their outer edges. Bottom flap 123 also has glue 125 over substantially its entire surface.

Also to be noted is the shape of the ends of flaps 113, 115, 117 and 123. All adjacent flaps have their ends cut so their end edges are perpendicular to an intersecting diagonal of front face 103. This shape permits flaps 113, 115, 117, and 123 to be folded against the reverse side of front face 103 without overlapping each other. Side flaps 115 and 117 also have notches 120 and 122 formed at their outer edges nearest the top edge of front face 103. As noted below notches 120 and 122 facilitate inserting a photograph or cards into the display device.

In FIG. 8 collapsible easel 129 can be seen. As with the prior embodiment collapsible easel 129 comprises a support panel 131 and a stay panel 133.

Also seen in FIG. 8 is an outer frame 130 having a bottom member 132, side members 134 and 136, and top member 138. Collapsible easel 129 is disposed inside of frame 130. The bottom edge of stay panel 133 is hinged to bottom member 132 by score 127 and the top edge of stay panel 133 is hinged to the bottom edge of support panel 131 by score 135.

Guide panel 137 is hinged by score 136 to support panel 131. As with the embodiment of FIG. 1 guide panel 137 is a U-shape member with tongues 138 and 140 forming the leg members of the U-shape. The other features of the blanks shown in FIGS. 7 and 8 are identical to that shown in FIG. 1. These features include aperture 139, slits 141, and apertures 145.

ASSEMBLY AND OPERATION OF FIGS. 7–11

To assemble the display device shown in the embodiments of FIGS. 7–11 blank 102 is centered over blank 101. Top flap 113, side flaps 115 and 117, and bottom flap 123 are folded against bottom member 132, side members 134 and 136, and top member 138 of frame 130, respectively. Pressure is exerted upon flaps 113, 115, 117, and 123 causing glue strips 114, 119, 121 and 125 to affix to the respective flaps of frame 130.

To complete this embodiment an optional elastic band 147 is placed onto the device of FIGS. 7 and 8 by running it over scores 136 and 127 and underneath collapsible easel 129. The fully assembled display device in its deployed position can be viewed in FIGS. 9–11.

Figure 9:
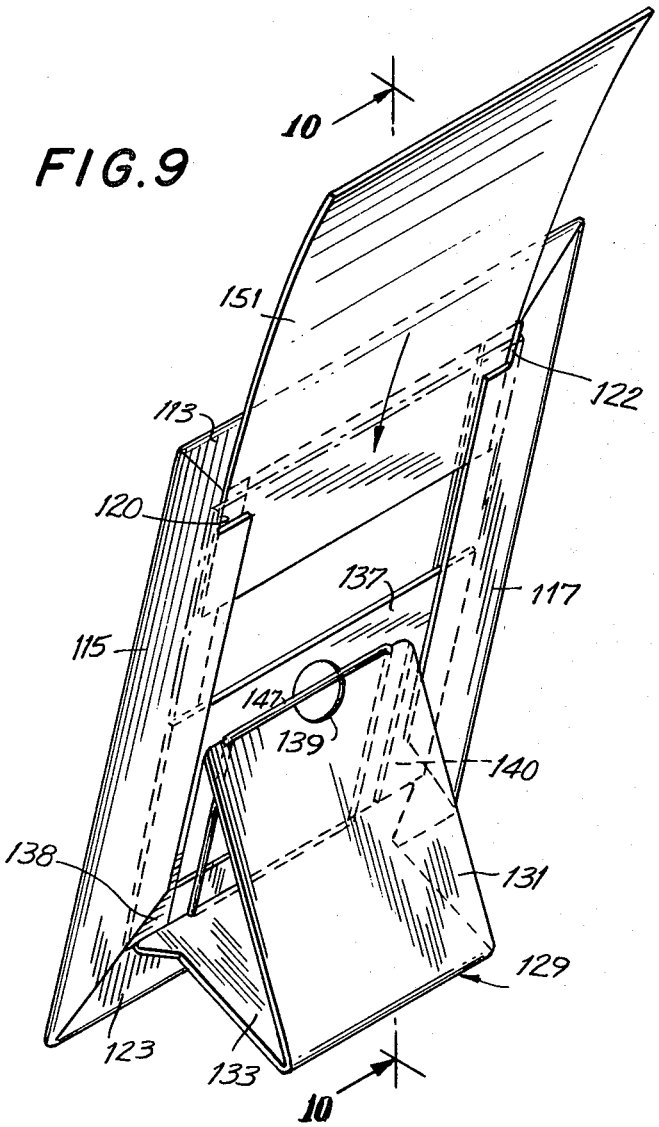
FIG. 9 is a rear perspective view of the fully assembled and deployed embodiment of FIGS. 7 and 8.
Figure 10:
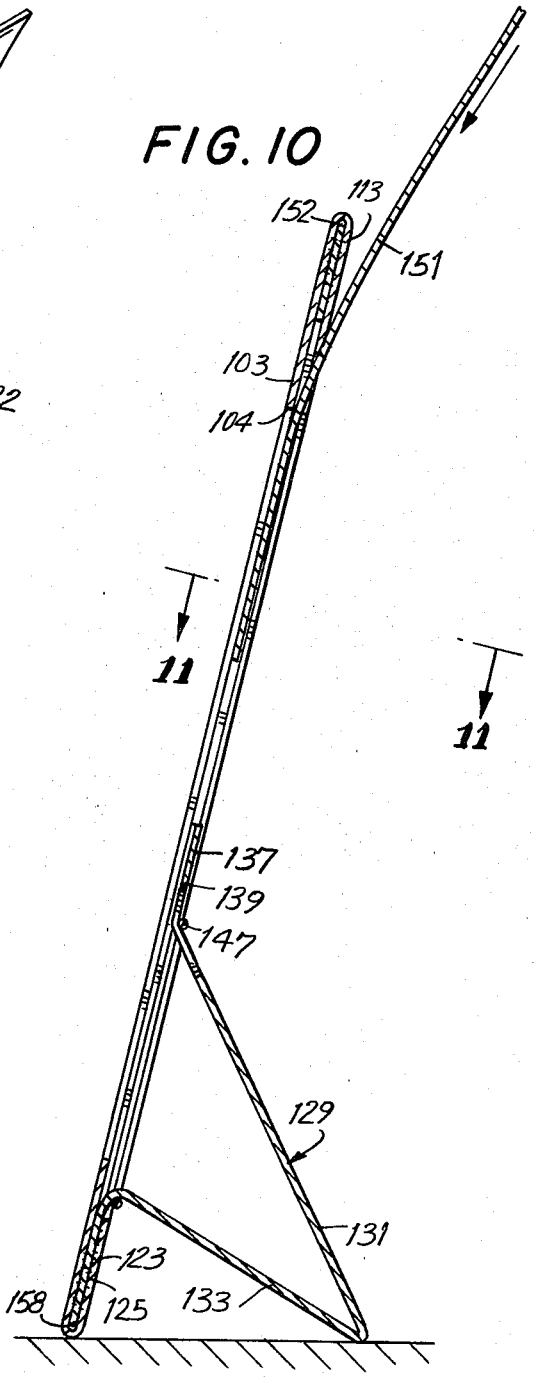
FIG. 10 is a side cross-sectional view of the fully deployed device along line 10—10 of FIG. 9.
Figure 11:
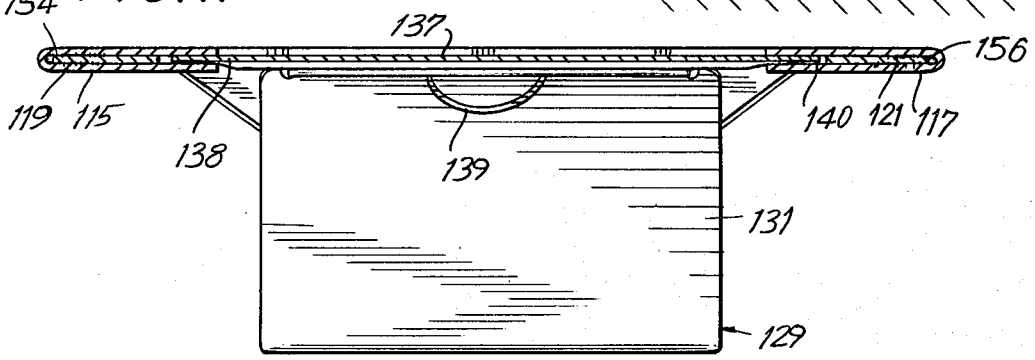
FIG. 11 is a plan cross-sectional view of the fully deployed device along line 11—11 of FIG. 10.

As particularly well shown in FIGS. 10 and 11 frame 130 adds an extra ply to the display device. Accordingly, the display device is stiffer than that of the embodiment shown in FIG. 1. Also shown in FIGS. 9 and 10 is the process of inserting a photograph 151 into the display device. In FIG. 9, strut 129 is in its undeployed position, i.e., when it is parallel to front face 103. In this position the top edge of guide panel 137 extends over notches 120 and 122 of side flaps 115 and 117. Accordingly, guide panel 137 also provides means for easily inserting photograph 151 into the display device behind side flaps 115 and 117.

While the invention has been described by a specific embodiment and an illustrated variation, the present invention is not limited. Obvious modifications will occur to those skilled in the art. For example, elastic band 47 can be omitted. In that case guide panel 37 can then be moved manually through means of finger aperture 39. Furthermore, rather than having a large aperture 4 in front face 3, front face 3 can be solid and information can be directly printed thereon. Similarly, the present invention can be adapted for use with display boxes or the like as shown in U.S. Pat. No. 4,149,630.

Thus, one skilled in the art can create various modifications without departing from the scope of this invention, as defined by the following claims.

What is claimed is:

1. A display device supportable at a predetermined angle to a horizontal surface having a collapsible easel comprising:

a guide panel slidably engaging said display device;

a support panel having first and second edges, said first edge hinged to said guide panel; and a stay panel having first and second edges, the first edge of said stay panel hinged to said second edge of said support panel and said second edge of said stay panel hinged to said display device.

2. A display device as in claim 1 wherein said guide panel comprises at least one tongue; and a groove on said display device in which said tongue moves permitting said guide means to slide from said first position from which said guide means, support panel and stay panel are substantially coplanar to a second position at which the angle between said stay panel and said support panel is less than 180°.

3. A display device as in claim 2 wherein the angle between said stay panel and said support panel is less than 90°.

4. A display device as in claim 1 wherein said guide means has two tongues; and said display device has two grooves, said grooves formed between the reverse surface of said front face and a flap hinged to the side of said front face and folded to lie against the reverse surface of said front face.

5. A display device as in claim 1 including;

a flap having two substantially parallel edges, the first of said edges hinged to the bottom edge of said front face, and the second of said edges hinged to said second edge of said stay panel.

6. A display device as in claim 4 including;

stop means contacted by said tongues to stop the movement of said guide panel at said second position.

7. A display device as in claim 4 including stop means contacted by said tongues to stop the movement of said guide panel at said second position, said stop means including a bottom flap hinged to the bottom edge of said front face and lying against the reverse side of said front face.

8. A display device as in claim 4 including an aperture in said front face through which to view card means located between the reverse side of said front face and said guide panel and wherein said grooves secure the edges of said card means.

9. A display device as in claim 1 wherein said guide means has two tongues; and said display device has two grooves.

* * * * *